US006655683B2

(12) United States Patent
Engarto et al.

(10) Patent No.: US 6,655,683 B2
(45) Date of Patent: Dec. 2, 2003

(54) THICKNESS MEASURING DEVICE FOR USE WITHIN A MAIL HANDLING SYSTEM, AND A METHOD OF USING THE SAME

(75) Inventors: Edward S. Engarto, Waverly, NY (US); William A. Arno, Binghamton, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 31 days.

(21) Appl. No.: 10/040,761

(22) Filed: Jan. 9, 2002

(65) Prior Publication Data

US 2003/0127792 A1 Jul. 10, 2003

(51) Int. Cl.[7] ..... B65H 7/12
(52) U.S. Cl. ..... 271/265
(58) Field of Search ..... 271/265, 265.04, 271/262, 263; 250/559.3; 73/1.81; 101/73; 324/229, 635, 644, 662, 671, 691, 716

(56) References Cited

U.S. PATENT DOCUMENTS 4,953,842 A * 9/1990 Tolmie et al. ..... 271/2
5,238,123 A 8/1993 Tovini et al.
5,704,246 A 1/1998 Kruger
5,727,692 A 3/1998 Large et al.
5,823,529 A * 10/1998 Mandel et al. ..... 271/296
6,123,330 A 9/2000 Schaal
6,135,292 A * 10/2000 Pettner ..... 209/603
2002/0011432 A1 * 1/2002 Tanimoto ..... 209/586

* cited by examiner

*Primary Examiner*—Donald P. Walsh
*Assistant Examiner*—Kenneth Bower
(74) *Attorney, Agent, or Firm*—Schwartz & Weinrieb

(57) ABSTRACT

A thickness measuring device for measuring the thickness dimension of an article being conveyed along a conveyor system comprises a rotary encoder, and a lever arm pivotally mounted upon the shaft of the rotary encoder. The lever arm has an end portion thereof disposed adjacent to the conveyor path so as to be deflected by an article conveyed along the conveying path. Deflection of the lever arm causes the rotary shaft of the rotary encoder to undergo a predetermined amount of rotation which is indicative of the thickness dimension of the article being conveyed. The system is also operatively associated with a storage bin such that when a plurality of articles, having a predetermined cumulative thickness dimension, are detected, further conveyance of articles to the storage bin is terminated.

33 Claims, 1 Drawing Sheet

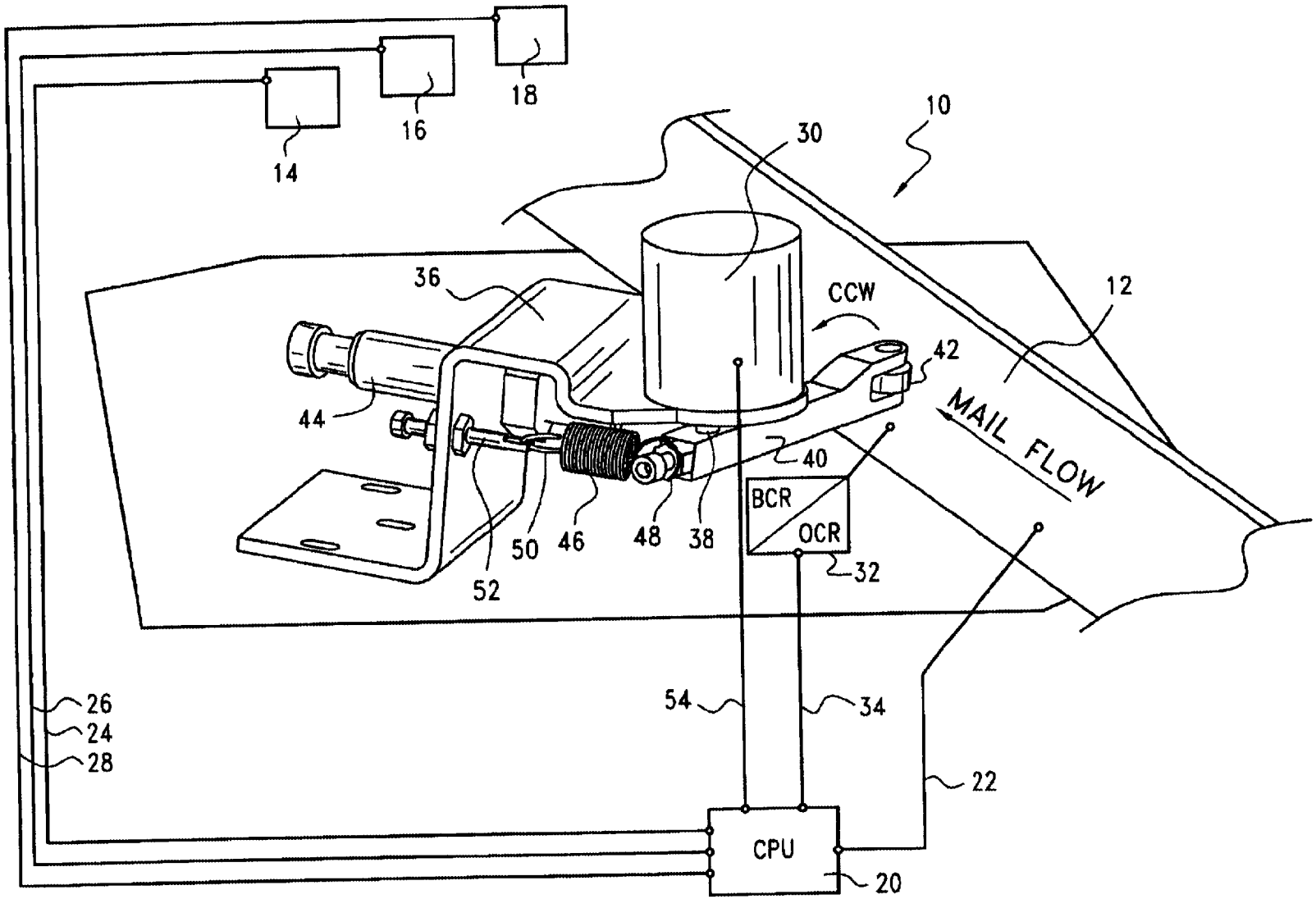
10
12
MAIL FLOW
42
CCW
30
40
BCR
OCR
32
34
22
20
CPU
38
48
54
46
50
52
36
44
18
16
14
26
24
28

THICKNESS MEASURING DEVICE FOR USE WITHIN A MAIL HANDLING SYSTEM, AND A METHOD OF USING THE SAME

FIELD OF THE INVENTION

The present invention relates generally to thickness measuring devices, and more particularly to a new and improved thickness measuring device or system, and a method of using the same, which is particularly useful in connection with the measuring or determining the thickness of individual articles, such as, for example, pieces or units of postal mail, wherein the articles may be any combination of envelopes, letters, catalogs, newspapers, magazines, greeting cards, and the like, such that an automatic mail delivery system, which delivers pieces or units of mail into sorting bins that are adapted to have mail pieces or units stacked therein up to a predetermined height or depth dimension, can stop depositing mail pieces or units into a particular sorting bin when the thickness measuring apparatus or system determines that the cumulative thickness dimensions of the detected and measured articles equals the predetermined height of the stack of mail pieces or units to be housed and contained within the particular sorting bin.

BACKGROUND OF THE INVENTION

Automatic mail delivery or conveying, sorting, and stacking systems are known which deliver pieces or units of mail, such as, for example, envelopes, letters, catalogs, newspapers, magazines, greeting cards, and the like, into sorting bins that are adapted to have pieces or units of mail stacked therein up to a particular height or depth dimension. Since the amount of volume that a particular sorting been could hold, contain, or accommodate would obviously comprise a particular number of pieces or units of mail having predetermined thickness dimensions, then it would be desirable for an automatic delivery or conveying, sorting, and stacking system to predetermine the thickness dimension of each individual unit or piece of mail, as well as to track the number of individual mail pieces or units detected or scanned so that a predetermined stack of mail can in fact be deposited within a particular sorting bin. PRIOR ART automated mail delivery or conveying, sorting, and stacking systems, however, have exhibited several operational drawbacks or deficiencies along these procedural lines. For example, in accordance with a first known type of automated mail delivery or conveying, sorting, and stacking system, while such a system is capable of tracking, ascertaining, or determining the number of pieces or units of mail that have been conveyed, sorted, and delivered to predetermined sorting bins, such a system has nevertheless been unable to accurately determine the thickness of each individual piece or unit of mail and to correlate such information with the total number of detected and counted pieces or units of mail. In particular, the thickness dimension of each individual piece or unit of mail is usually estimated in some manner by some means. In accordance with a second type of automated mail delivery or conveying, sorting, and stacking system, the system does not predetermine the thickness dimension of each individual piece or unit of mail, but to the contrary, the system simply determines or senses the height of the entire stack of mail deposited within each individual sorting bin. For example, each sorting bin is provided or equipped with photocell systems which are accordingly activated when the stack of mail deposited within a particular sorting bin reaches or attains a predetermined height or level. This type of system is relatively expensive, however, in view of the fact that each sorting bin must be equipped with its own photocell detection system.

Systems also exist which are capable of determining thickness dimensions of, for example, flat mail pieces or units, however, such systems have not been employed for determining the thickness dimensions of individual pieces or units of mail such that the determined thickness dimensions can then be correlated or used in connection with the counted or detected number of individual pieces or mails so as to correspondingly determine the height of a stack of mail deposited within a particular sorting bin. For example, as disclosed within U.S. Pat. No. 6,123,330 which issued to Schaal on Sep. 26, 2000, a suction separation system is utilized in connection with the conveyance of flat mail pieces, and the system utilizes a rotary potentiometer to determine the thickness dimension of each stack item wherein the thickness dimension is related to, or is a function of, the stack pressure which is suitably monitored, corrected, adjusted, and controlled. In a similar manner, as disclosed within U.S. Pat. No. 5,727,692 which issued to Large et al. on Mar. 17, 1998, the thickness dimensions of envelopes is determined, however, such thickness dimensions are determined as a means for correspondingly determining whether or not any contents are present within a particular envelope. Still further, as disclosed within U.S. Pat. No. 5,704,246 which issued to Kruger on Jan. 6, 1998, a raster gauge is used to determine the thickness dimensions of objects in order to, in turn, determine whether or not such objects can be subsequently handled by means of other machines or equipment located downstream within the overall processing or handling system. As disclosed within U.S. Pat. No. 5,238,123 which issued to Tovini et al. on Aug. 24, 1993, a system is employed to determine thickness and length dimensions or parameters of envelopes whereby those envelopes which do not have length and thickness dimensions which are within a predetermined range of values are removed from the particularly disclosed handling system. Lastly, as disclosed within U.S. Pat. No. 4,953,842 which issued to Tolmie, Jr. et al. on Sep. 4, 1990, there is disclosed a system for determining the thickness dimensions of mail pieces or units such that the mail pieces or units can be properly conveyed by means of a particular handling system in accordance with a predetermined velocity sequence or profile.

A need therefore exists in the art for a new and improved thickness measuring device, and a method of using the same, for use within a mail handling system wherein the thickness measuring device can determine the thickness dimension of individual pieces or units of mail as the same are conveyed past the device, and such thickness information or data can be correlated with the number of scanned or detected pieces or units of mail which are being delivered to predetermined sorting bins so as to determine the precise number of mail pieces or units than can be deposited within a particular sorting or storage bin such that the stack of mail disposed, housed, or contained within the particular sorting or storage bin has a predetermined height dimension whereupon further conveyance of mail units or pieces to such sorting or storage bin can be terminated until such sorting or storage bin has been emptied or replaced.

OBJECTS OF THE INVENTION

Accordingly, it is an object of the present invention to provide a new and improved thickness measuring device, and a method of using the same, for determining the thickness dimensions of individual pieces or units of mail, and a mail handling, sorting, and stacking system incorporating the same therein, wherein the mail handling, sorting, and stacking system stacks a predetermined amount of mail within a sorting or storage bin.

Another object of the present invention is to provide a new and improved thickness measuring device, and a method of using the same, for determining the thickness dimensions of individual pieces or units of mail, and a mail handling, sorting, and stacking system, having the thickness measuring device incorporated therein, for stacking a predetermined amount of mail within a sorting or storage bin in accordance with techniques which effectively overcome the various operational deficiencies characteristic of PRIOR ART systems.

An additional object of the present invention is to provide a new and improved thickness measuring device, and a method of using the same, for determining the thickness dimensions of individual pieces or units of mail, and a mail handling, sorting, and stacking system incorporating the same therein, wherein the thickness dimension data or information for each individual piece or unit of mail can be used in connection with the stacking of a predetermined amount of mail within a particular sorting or storage bin.

A further object of the present invention is to provide a new and improved thickness measuring device, and a method of using the same, for determining the thickness dimensions of individual pieces or units of mail, and a mail handling, sorting, and stacking system incorporating the same therein, wherein the thickness dimension data or information for each individual piece or unit of mail can be correlated with the number of detected or scanned pieces or units of mail such that a predetermined number of mail pieces or units can be stacked within a particular sorting or storage bin.

A last object of the present invention is to provide a new and improved thickness measuring device, and a method of using the same, for determining the thickness dimensions of individual pieces or units of mail, and a mail handling, sorting, and stacking system incorporating the same therein, wherein the thickness dimension data or information for each individual piece or unit of mail can be correlated with the number of detected or scanned pieces or units of mail such that a predetermined number of mail pieces or units can be stacked within a particular sorting or storage bin such that the stacked mail has a predetermined height dimension whereupon further deposits of mail within such sorting or storage bin are discontinued.

SUMMARY OF THE INVENTION

The foregoing and other objectives are achieved in accordance with the teachings and principles of the present invention through the provision of a new and improved thickness measuring device, a method of using the same, and a mail handling system in which the thickness measuring device is incorporated, wherein the thickness measuring device comprises a rotary encoder mounted upon a mounting bracket, and wherein further, a movable lever arm is fixedly connected to the rotary shaft of the rotary encoder. A first end of the lever arm has an idler wheel or roller mounted thereon which is adapted to be disposed in contact with, or encounter, mail pieces or units as the mail units or pieces are conveyed along a conveyor path. A hydraulic damper is disposed in contact with the first end of the lever arm, while a second opposite end of the lever arm is fixedly connected to a biasing return spring. As the mail pieces or units respectively encounter the idler wheel or roller of the lever arm, each mail piece or unit will cause deflection of the lever arm a predetermined amount, as controlled by means of the hydraulic damper and biasing return spring, in accordance with the thickness dimension of the particular mail piece or unit, and the deflection of the lever arm will accordingly cause rotation of the rotary shaft of the rotary encoder. The encoder impulse data, corresponding to the rotation of the rotary shaft of the rotary encoder and the deflection amount of the lever arm in accordance with the thickness of the particular piece or unit of mail, will be transmitted to a computer wherein software will effectively convert such impulse data into linear deflection amounts or thickness dimensions or parameters characteristic of the particular unit or piece of mail.

The computer software also keeps track of the particular pieces or units of mail, through means of, for example, suitable bar code reader (BCR) or optical character recognition (OCR) apparatus, and correlates the same with the calculated thickness data for each one of the mail pieces or units detected and encountered by means of the rotary encoder lever arm. Stacking storage capacity data for each sorting or storage bin is also pre-entered into the computer, and therefore, the computer can accordingly control the conveyor system such that when a predetermined number of units or pieces of mail, having a cumulative thickness dimension as determined by means of the computer as derived or calculated from the data supplied thereto from the rotary encoder, has been conveyed to a particular sorting or storage bin which has a predetermined mail piece or unit stacking or storage capacity which equals the cumulative thickness dimension or parameter of the predetermined number of detected or encountered pieces or units of mail, the convey- or will terminate further conveyance of mail to such sorting or storage bin until such sorting or storage bin has either been emptied or replaced by means of a correspondingly sized storage or sorting bin. The system is capable of being utilized in connection with the conveyance of substantially all types of mail including, but not limited to, envelopes, letters, catalogs, newspapers, magazines, greeting cards, and the like.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

The SOLE FIGURE is a schematic drawing of a new and improved thickness measuring device, as incorporated within an article handling system, for determining the thickness dimensions of conveyed articles, such as, for example, various pieces or units of mail, such that a predetermined number of articles, or mail pieces or units, can be deposited within a particular storage or sorting bin having a predetermined storage or stacking capacity.

DETAILED DESCRIPTION OF THE PREFERRED EMBODIMENT

Referring now to the drawings, and more particularly to the SOLE FIGURE thereof, a new and improved article handling system, having a new and improved thickness measuring device incorporated therein, is disclosed and is generally indicated by the reference character 10. While the article handling system 10 can be adapted for use in connection with the handling or conveyance of substantially different types of articles, for the purposes of the present invention disclosure, the article handling system 10 will be directed toward the handling and conveyance of pieces or units of mail which may, for example, include, but is not necessarily limited to, envelopes, letters, catalogs, newspapers, magazines, greeting cards, and the like. More particularly, it is seen that the new and improved article handling system 10 comprises an article conveyor system as defined by means of a pair of opposed conveyor belts 12 between which articles, such as, for example, various pieces or units of mail, may be conveyed toward a plurality of sorting or storage bins 14, 16, 18. In accordance with the particularly novel and unique structure or system which has been developed in accordance with the principles and teachings of the present invention, a central processing unit (CPU) 20 is operatively connected to the article con-veyor belt drive system 12 by means of signal or communication lines schematically illustrated at 22 in order to not only control the operation of the article conveyor system 12, but in addition, to control various sorting gates, not shown, operatively connected to or comprising the article conveyor system 12 in a well-known manner such that articles being conveyed along article conveyor system 12 may be properly routed to or conducted toward a particular one of the plurality of sorting or storage bins 14, 16, 18. It is also to be appreciated at this juncture that while the sorting or storage bins 14, 16, 18 have been illustrated as being "connected" to the central processing unit 20 by means of lines 24, 26, 28, lines 24, 26, 28 do not actually represent communication or signal lines between the sorting or storage bins 14, 16, 18 and the central processing unit 20, but have been illustrated simply as a means for conveying the idea that the central processing unit 20 is aware of the existence of each one of the plurality of sorting or storage bins 14, 16, 18, as well as the storage capacity characteristic of each one of the plurality of sorting or storage bins 14, 16, 18, and accordingly correlates such existence, disposition, or location of such sorting or storage bins 14, 16, 18, and their respective storage capacities, with the article conveyor system 12 along which individual articles are being conveyed.

Continuing further, in accordance with the principles and teachings of the present invention, it is to be recalled that the primary objective of the present invention is to predetermine the thickness dimensions or parameters of the articles being conveyed along the article conveyor system 12 such that, knowing the storage capacity of each one of the sorting or storage bins 14, 16, 18, the central processing unit 20 can terminate further conveyance of articles to a particular one of the plurality of sorting or storage bins 14, 16, 18 when the storage capacity of that particular one of the sorting or storage bins 14, 16, 18 has been reached as a result of having had deposited into such particular one of the plurality of sorting or storage bins 14, 16, 18 a plurality of articles having a cumulative thickness dimension value which is equal to the storage capacity of that particular one of the sorting or storage bins 14, 16, 18. Accordingly, in order to determine the thickness dimension of each article as the same is being conveyed along the article conveyor system 12, a rotary encoder 30 is located at a position which is located adjacent to the mail flow path of the article conveyor system 12. A bar code reader/optical character recognition device 32 is also disposed adjacent to the disposition of the rotary encoder 30 and is likewise positioned adjacent to the article conveyor system 12 at a position upstream of the rotary encoder 30 as considered in the direction of conveyance of the articles along the article conveyor system 12. The bar code reader/optical character recognition device 32 is connected to the central processing unit 20 by means of a signal or communication line 34, and in this manner, each individual piece or unit of mail conveyed along the article conveyor system 12 is detected and read by means of the bar code reader/optical character recognition device 32, and such identification information is transmitted to the central processing unit 20 such that the central processing unit 20 can effectively track the particular or individual piece or unit of mail.

In addition, it is seen that the rotary encoder 30 is mounted upon a suitable Z-shaped mounting bracket 36, and that a rotary shaft 38 of the rotary encoder 30 has a lever arm 40 fixedly mounted upon the lower end portion thereof. The lever arm 40 is juxtaposed with respect to the article conveyor system 12 so as to position an idler wheel or idler roller 42, which is mounted upon one end portion of the lever arm 40, immediately adjacent to the mail flow path of the article conveyor system 12. More particularly, the idler wheel or idler roller 42 is adapted to normally be disposed in contact with the outer one of the oppositely disposed or paired conveyor belts 12 as a result of a piston member, not shown, of, for example, a suitable, single-acting hydraulic damper 44 normally being disposed in contact with the end of the lever arm 40 upon which the idler wheel or roller 42 is mounted. The hydraulic damper 44 is fixedly mounted upon the Z-shaped mounting bracket 36, and the opposite end of the lever arm 40 is operatively connected to a return spring mechanism 46. As can be seen from the drawing, a first end portion 48 of the return spring mechanism 46 is connected to the lever arm 40, while a second end portion 50 of the return spring mechanism 46 is connected to a mounting bolt assembly 52 which is fixedly mounted upon the Z-shaped mounting bracket 36.

Accordingly, when a particular piece or unit of mail is conveyed along the article conveyor system 12, the piece or unit of mail will cause the outer one of the conveyor belts 12, with which the idler wheel or roller 42 of the lever arm 40 is disposed in contact, to move outwardly and thereby cause counterclockwise deflection of the lever arm 40 against the opposite biases of the return spring 46 and hydraulic damper 44 as denoted by the arrow CCW. Rotation or pivotal movement of the lever arm 40, in turn, will cause a corresponding rotation or pivotal movement of the rotary encoder shaft 38 such that encoder impulses are generated by the rotary encoder 30. It is noted that the use of the single-acting hydraulic damper 44 permits the piston rod member, not shown, thereof to be extended out from the hydraulic damper 44 in a faster operative mode than that characterizing the contraction mode of the piston rod member, not shown, into the hydraulic damper 44. This is important during the pivotal movement of the lever arm 40 in that once a piece or article of mail has passed by the idler roller or wheel 42 whereby the lever arm 40 will then tend to return to its normally undeflected position, the piston rod member, not shown, of the hydraulic damper 44 will tend to prevent any "bounce-back" of the lever arm 40 and effectively ensure maintenance of the lever arm 40 at its normally undeflected position adjacent to the mail article flow path along conveyor system 12 so as to be in an operative position to detect the next piece or article of mail being conveyed along the conveyor system 12.

As is known in the art, a rotary encoder can generate a predetermined number of impulses per a complete revolution, or in other words, for example, one thousand (1000) impulses per 360° of rotation. Therefore, for a predetermined angular movement of the lever arm 40, and a corresponding angular movement of the rotary encoder shaft 38, a predetermined number of impulses will be generated by the rotary encoder. The impulses from the rotary encoder 30 are transmitted to the central processing unit 20, by means of a signal or communication line 54, in which software can convert or correlate the angular movement of the lever arm 40, and the corresponding angular movement of the rotary encoder shaft 38, as signified or indicated by the number of impulses generated by the rotary encoder 30, to linear values which are therefore indicative of the thickness dimension of the particular piece or unit of mail just detected or sensed by the lever arm 40 and its operatively associated idler wheel or roller 42.

In view of the fact that such detected or sensed particular piece or unit of mail has also just been immediately previously identified by means of the bar code reader/optical character recognition device 32, and that this mail piece or unit identification information has therefore also been transmitted to the central processing unit 20 by means of signal or communication line 34, the central processing unit 20 correlates such information to the effect that a particularly identified unit or piece of mail has a particular thickness dimension. In view of the additional fact that the central processing unit 20 not only knows the storage capacity of each one of the storage or sorting bins 14, 16, 18, but also knows the routing destination of each previously identified and detected or sense piece or unit of mail, then based upon the cumulative thickness dimensions of a plurality of previously identified and detected or sensed pieces or units of mail which are being routed to a particular destination comprising one of the sorting or storage bins 14, 16, 18, the central processing unit 20 will know when the storage or stacking capacity of that particular one of the storage or sorting bins 14, 16, 18 has been or will be reached. The central processing unit 20 can therefore terminate any further conveyance of pieces or units of mail to such particular destination storage or sorting bin 14, 16, or 18 until such storage or sorting bin 14, 16, or 18 has been emptied or replaced.

It is lastly to be appreciated that while the lever arm 40, and its operatively associated idler wheel or roller 42, have been disclosed within the article handling system 10 as being disposed in contact with an outer surface of an outer one of the conveyor belts 12 for those conveyor systems 12 within which the articles are conveyed between a pair of oppositely disposed conveyor belts 12, substantially the same system comprising lever arm 40, and its operatively associated idler wheel or roller 42, could likewise be employed in connection with those conveyor systems wherein articles are conveyed along, for example, a single conveyor belt, such as, for example, by means of suction or other implements. In connection with such a conveyor system, it is to be appreciated that the idler wheel or roller 42 of the lever arm 40 will normally be disposed in contact with the surface of the conveyor belt along which the articles are being conveyed and will therefore be directly engaged by the conveyed article such that the lever arm 40 will undergo the corresponding aforenoted deflected movement. In either case or instance, the basic operation of the system 10 is substantially the same, that is, deflection of the lever arm 40, as detected by means of the rotary encoder 30, will be indicative of the thickness dimension of the particular unit or piece of mail detected or sensed.

Thus, it may be seen that in accordance with the principles and teachings of the present invention, a new and improved article handling system, having a new and improved thickness measuring device incorporated therein, has been developed whereby thickness dimensions of conveyed articles, such as, for example, pieces or units of mail, can be readily determined. In addition, such determined thickness dimensions can be correlated with particular article identification information or data such that the cumulative or total thickness value of a plurality of conveyed articles can be readily determined. This information can, in turn, be utilized in connection with the conveyance of a plurality of articles toward destination storage or sorting bins within which articles are to be stacked to a predetermined height or level. When the system determines that the predetermined height or level within a particular storage or sorting bin has been or will be reached, further conveyance of articles by the article handling system and toward such storage or sorting bin is terminated and is not resumed until the particular sorting or storage bin has been emptied or replaced by means of a new sorting or storage bin.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A system for measuring the thickness dimension of an article being conveyed along a predetermined conveyor path, comprising:

an article conveyor for conveying a plurality of articles along a predetermined conveyor path, wherein each one of the conveyed articles has a predetermined thickness dimension;

a mounting bracket;

a rotary encoder mounted upon said mounting bracket and comprising a rotary shaft; and a lever arm movably mounted upon said rotary shaft of said rotary encoder and having a first end portion thereof disposed in contact with said article conveyor in order to engage each one of the articles being conveyed along said predetermined conveyor path by said article conveyor, whereupon said first end portion of said lever arm encountering an article being conveyed along said predetermined conveyor path by said article conveyor, said lever arm will movably deflect a predetermined amount and cause a corresponding rotation of said rotary shaft of said rotary encoder which is indicative of the thickness of the article being conveyed along the predetermined conveyor path by said article conveyor.

2. The system as set forth in claim 1, further comprising:

an idler roller rotatably mounted upon said first end portion of said lever arm for engaging the article being conveyed along said predetermined conveyor path.

3. The system as set forth in claim 2, further comprising:

first biasing means operatively connected to said first end portion of said lever arm for generating a first predetermined biasing force for normally resisting said movement of said lever arm in response to said engagement of said idler roller with the article being conveyed along said predetermined conveyor path, and for generating a second biasing force tending to return said lever arm to its non-deflected position; and second biasing means operatively connected to a second end portion of said lever arm for generating a first predetermined biasing force for normally resisting said movement of said lever arm in response to said engagement of said idler roller with the article being conveyed along said predetermined conveyor path, and for generating a second biasing force tending to return said lever arm to its non-deflected position.

4. The system as set forth in claim 3, wherein:

said first biasing means comprises a single-acting hydraulic damper; and said second biasing means comprises a coil spring.

5. The system as set forth in claim 4, wherein:

said single-acting hydraulic damper has a cylinder portion thereof fixedly mounted upon said mounting bracket and a piston rod member thereof operatively engaged in abutment contact with said first end portion of said lever arm; and said coil spring has a first end portion fixedly connected to said second end portion of said lever arm, and a second end portion fixedly connected to said mounting bracket.

6. A system as set forth in claim 3, wherein:

said rotary shaft of said rotary encoder is disposed along a vertically oriented axis; and said lever arm is pivotally mounted upon said rotary shaft of said rotary encoder for movement within a substantially horizontal plane around said vertically oriented axis.

7. The system as set forth in claim 6, wherein:

said first biasing means is operatively connected to said first end portion of said lever arm which is disposed upon a first side of said vertically oriented axis about which said lever arm is pivotally mounted; and said second biasing means is operatively connected to said second end portion of said lever arm which is disposed upon a second side of said vertically oriented axis about which said lever arm is pivotally mounted.

8. A conveyor system for depositing a predetermined number of articles, having a predetermined cumulative thickness dimension, into a storage bin having a predetermined storage capacity, comprising:

a storage bin having a predetermined storage capacity for accommodating therein a predetermined number of articles having a predetermined cumulative thickness dimension such that the predetermined number of articles can be stored within said storage bin;

an article conveyor for conveying a plurality of articles along a predetermined conveyor path toward said storage bin, wherein each one of the conveyed articles has a predetermined thickness dimension;

a mounting bracket;

a rotary encoder mounted upon said mounting bracket and comprising a rotary shaft;

a lever arm movably mounted upon said rotary shaft of said rotary encoder and having a first end portion thereof disposed adjacent to said predetermined conveyor path so as to engage each one of the articles being conveyed along said predetermined conveyor path, whereupon said first end portion of said lever arm encountering an article being conveyed along said predetermined conveyor path, said lever arm will movably deflect a predetermined amount and cause a corresponding rotation of said rotary shaft of said rotary encoder such that said rotary encoder emits data which is indicative of the thickness dimension of the article being conveyed along said predetermined conveyor path; and means operatively connected to said article conveyor for correlating said thickness dimension data of each article being conveyed along said predetermined conveyor path with said predetermined storage capacity of said storage bin such that when the cumulative thickness dimension of a plurality of articles being conveyed along said predetermined conveyor path, as indicated by said thickness dimension data emitted by said rotary encoder, comprises a predetermined value with respect to said storage capacity of said storage bin, operation of said article conveyor will be terminated so as not to deposit any additional articles into said storage bin.

9. The system as set forth in claim 8, wherein:

said means operatively connected to said article conveyor comprises a central processing unit (CPU).

10. The system as set forth in claim 9, further comprising:

reader means for reading indicia upon each one of the articles being conveyed along said predetermined conveyor path by said article conveyor and for transmitting said read indicia to said central processing unit (CPU) such that said central processing unit (CPU) is enabled to track each individual article being conveyed along said predetermined conveyor path of said article conveyor.

11. The system as set forth in claim 10, wherein:

said central processing unit (CPU) has stored therein said predetermined storage capacity of said storage bin so as to be able to correlate said storage capacity of said storage bin with the cumulative thickness dimension data of the plurality of articles being conveyed along said predetermined conveyor path of said article conveyor.

12. The system as set forth in claim 10, wherein:

said reader comprises a bar code reader.

13. The system as set forth in claim 10, wherein:

said reader comprises an optical character recognition reader.

14. The system as set forth in claim 8, further comprising:

an idler roller rotatably mounted upon said first end portion of said lever arm for engaging the article being conveyed along the predetermined conveyor path.

15. The system as set forth in claim 8, further comprising:

first biasing means operatively connected to a first end portion of said lever arm for generating a first predetermined biasing force for normally resisting said movement of said lever arm in response to said engagement of said idler roller with the article being conveyed along the predetermined conveyor path, and for generating a second biasing force tending to return said lever arm to its non-deflected position; and second biasing means operatively connected to a second end portion of said lever arm for generating a first predetermined biasing force for normally resisting said movement of said lever arm in response to said engagement of said idler roller with the article being conveyed along the predetermined conveyor path, and for generating a second biasing force tending to return said lever arm to its non-deflected position.

16. The system as set forth in claim 15, wherein:

said first biasing means comprises a single-acting hydraulic damper; and said second biasing means comprises a coil spring.

17. The system as set forth in claim 16, wherein:

said single-acting hydraulic damper has a cylinder portion thereof fixedly mounted upon said mounting bracket and a piston rod member thereof operatively engaged in abutment contact with said first end portion of said lever arm; and said coil spring has a first end portion fixedly connected to said second end portion of said lever arm, and a second end portion fixedly connected to said mounting bracket.

18. A method for depositing a predetermined number of articles, having a predetermined cumulative thickness dimension, into a storage bin having a predetermined storage capacity, comprising:

providing a storage bin having a predetermined storage capacity for accommodating therein a predetermined number of articles having a predetermined cumulative thickness dimension such that the predetermined number of articles can be stored within said storage bin;

providing an article conveyor for conveying a plurality of articles along a predetermined conveyor path toward said storage bin, wherein each one of the conveyed articles has a predetermined thickness dimension;

positioning a rotary encoder, having a rotary shaft, adjacent to said article conveyor;

movably mounting a lever arm upon said rotary shaft of said rotary encoder wherein a first end portion of said lever arm is disposed adjacent to said predetermined conveyor path so as to engage each one of the articles being conveyed along said predetermined conveyor path, whereupon said first end portion of said lever arm encountering an article being conveyed along said predetermined conveyor path, said lever arm will movably deflect a predetermined amount and cause a corresponding rotation of said rotary shaft of said rotary encoder such that said rotary encoder will emit data which is indicative of the thickness dimension of the article being conveyed along said predetermined conveyor path;

providing means for correlating said thickness dimension data of each article being conveyed along said predetermined conveyor path with said predetermined storage capacity of said storage bin; and controlling the operation of said article conveyor in such a manner that when the cumulative thickness dimension of a plurality of articles being conveyed along said predetermined conveyor path of said article conveyor, as indicated by said thickness dimension data emitted by said rotary encoder, comprises a predetermined value with respect to said storage capacity of said storage bin, operation of said article conveyor will be terminated so as not to deposit any additional articles into said storage bin.

19. The method as set forth in claim 18, wherein:

said steps of correlating said thickness dimension data with said storage capacity of said storage bin, and of controlling the operation of said article conveyor, are performed by a central processing unit (CPU).

20. The method as set forth in claim 19, further comprising the step of:

providing reader means for reading indicia upon each one of the articles being conveyed along said predetermined conveyor path by said article conveyor and for transmitting said read indicia to said central processing unit (CPU) such that said central processing unit (CPU) is enabled to track each individual article being conveyed along said predetermined conveyor path of said article conveyor.

21. The method as set forth in claim 20, wherein:

said step of correlating said storage capacity of said storage bin with the cumulative thickness dimension data of the plurality of articles being conveyed along said predetermined conveyor path of said article conveyor comprises the step of storing said predetermined storage capacity of said storage bin within said central processing unit (CPU).

22. The method as set forth in claim 20, further comprising the step of:

using a bar code reader as said reader means.

23. The method as set forth in claim 20, further comprising the step of:

using an optical character recognition reader as said reader means.

24. The method as set forth in claim 18, further comprising the step of:

rotatably mounting an idler roller upon said first end portion of said lever arm for engaging the article being conveyed along the predetermined conveyor path.

25. The method as set forth in claim 18, further comprising the step of:

operatively connecting a first biasing means to a first end portion of said lever arm for generating a first predetermined biasing force for normally resisting said movement of said lever arm in response to said engagement of said idler roller with the article being conveyed along the predetermined conveyor path, and for generating a second biasing force tending to return said lever arm to its non-deflected position; and operatively connecting a second biasing means to a second end portion of said lever arm for generating a first predetermined biasing force for normally resisting said movement of said lever arm in response to said engagement of said idler roller with the article being conveyed along the predetermined conveyor path, and for generating a second biasing force tending to return said lever arm to its non-deflected position.

26. The method as set forth in claim 25, wherein:

using a single-acting hydraulic damper as said first biasing means; and using a coil spring as said second biasing means.

27. The method as set forth in claim 26, wherein:

fixedly mounting a cylinder portion of said single-acting hydraulic damper upon a mounting bracket and operatively engaging a piston rod member of said hydraulic damper in abutment contact with said first end portion of said lever arm; and fixedly connecting a first end portion of said coil spring to said second end portion of said lever arm, and fixedly connecting a second end portion of said coil spring to said mounting bracket.

28. A system for measuring the thickness dimension of an article being conveyed along a predetermined conveyor path, comprising:

a mounting bracket;

a rotary encoder mounted upon said mounting bracket and comprising a rotary shaft;

a lever arm movably mounted upon said rotary shaft of said rotary encoder and having a first end portion thereof disposed adjacent to the predetermined conveyor path so as to engage an article being conveyed along the predetermined conveyor path, whereupon said first end portion of said lever arm encountering an article being conveyed along the predetermined conveyor path, said lever arm will movably deflect a predetermined amount and cause a corresponding rotation of said rotary shaft of said rotary encoder which is indicative of the thickness of the article being conveyed along the predetermined conveyor path;

first biasing means fixedly mounted at a first end portion thereof and operatively connected at a second end portion thereof to said first end portion of said lever arm for generating a first predetermined biasing force for normally resisting said movement of said lever arm in response to said engagement of said first end portion of said lever arm with the article being conveyed along the predetermined conveyor path, and for generating a second biasing force tending to return said lever arm to its non-deflected position; and second biasing means fixedly mounted at a first end portion thereof and operatively connected at a second end portion thereof to a second end portion of said lever arm for generating a first predetermined biasing force for normally resisting said movement of said lever arm in response to said engagement of said first end portion of said lever arm with the article being conveyed along the predetermined conveyor path, and for generating a second biasing force tending to return said lever arm to its non-deflected position.

29. The system as set forth in claim 28, further comprising:

an idler roller rotatably mounted upon said first end portion of said lever arm for engaging the article being conveyed along the predetermined conveyor path.

30. The system as set forth in claim 28, wherein:

said first biasing means comprises a single-acting hydraulic damper; and said second biasing means comprises a coil spring.

31. The system as set forth in claim 30, wherein:

said single-acting hydraulic damper has a cylinder portion thereof fixedly mounted upon said mounting bracket and a piston rod member thereof operatively engaged in abutment contact with said first end portion of said lever arm; and said coil spring has a first end portion fixedly connected to said mounting bracket, and a second end portion fixedly connected to said lever arm.

32. The system as set forth in claim 28, wherein:

said rotary shaft of said rotary encoder is disposed along a vertically oriented axis; and said lever arm is pivotally mounted upon said rotary shaft of said rotary encoder for movement within a substantially horizontal plane around said vertically oriented axis.

33. The system as set forth in claim 32, wherein:

said first biasing means is operatively connected to said first end portion of said lever arm which is disposed upon a first side of said vertically oriented axis about which said lever arm is pivotally mounted; and said second biasing means is operatively connected to said second end portion of said lever arm which is disposed upon a second side of said vertically oriented axis about which said lever arm is pivotally mounted.

* * * * *